US006005176A

United States Patent [19]

Yu

[11] Patent Number: 6,005,176

[45] Date of Patent: Dec. 21, 1999

[54] LIGHT GUITAR SUPPORT

[76] Inventor: Ming-Ti Yu, 122-5, Jun Liao Rd., Feng Yuan, Taichung Shien, Taiwan

[21] Appl. No.: 09/267,202

[22] Filed: Mar. 12, 1999

[51] Int. Cl.[6] ..... G10D 3/00

[52] U.S. Cl. ..... 84/327; 84/453; 248/443

[58] Field of Search ..... 84/327, 421, 453; 248/443

[56] References Cited

U.S. PATENT DOCUMENTS 3,765,633 10/1973 Caudill ..... 248/229

*Primary Examiner*—Robert E. Nappi
*Assistant Examiner*—Shih-yung Hsieh

[57] ABSTRACT

A light guitar support includes a support rod, an adjusting unit, two leg supports, two brackets, an upper support rod, a support seat, and a fastening device. The support rod has a lower portion and an upper portion. The upper portion is bent about an angle with respect to the lower portion and forms an insert portion for receiving a lower end of the upper support rod. The support seat is mounted on an upper end of the upper support rod. The support seat includes a transverse clamping plate and a longitudinal clamping plate. The fastening device is mounted at a rear end of the transverse clamping plate to be held thereby when in use or when folded. The fastening device includes an upright bar, a substantially U-shaped fastening seat, a positioning sleeve, and two curved bars. The upright bar has a front end and a rear end. The rear end of the upright bar is mounted on the transverse clamping plate to thereby couple the fastening device to the support seat. The fastening seat is secured to the front end of the upright bar. The protective sleeve is fitted over the fastening seat. The positioning sleeve has a front side formed with two bar receiving holes that have a shape resembling the numeral "8". The curved bars are received in the bar receiving holes such that the curved bars can displace inwardly to a closing position or outwardly to an opening position to clamp or release an upper portion of a guitar to thereby protect the guitar from possible damage.

2 Claims, 6 Drawing Sheets

LIGHT GUITAR SUPPORT

BACKGROUND OF THE INVENTION (a) Field of the Invention

The present invention relates to a light guitar support, more particularly to a light guitar support that can positively hold a guitar in position and protect the guitar from possible damage, and that is foldable in a convenient manner.

(b) Description of the Prior Art

In R.O.C. Utility Model Patent Application No. 84212206 (Publication No. 112704), the inventor of the present invention discloses a light guitar support that comprises a support rod, a T-shaped adjusting frame, two leg supports, two brackets, and two support rods. The guitar support disclosed therein is characterized in that the T-shaped adjusting frame is mounted at an upper end of the support rod, and includes a tongue and a T-shaped plate for mounting of the leg supports such that the leg supports extend in a cross-shape (i.e., in all four directions) to enable the guitar support to stand firmly on the floor. The brackets are mounted at lower ends of the leg supports for securing the support rod that is adapted for placement of a guitar, thereby providing a foldable guitar support that is convenient to use. As the above-mentioned guitar support is compact and foldable, it is convenient to carry, package, and transport. Besides, packaging and transportation costs can be reduced. In use, the guitar can be simply placed on the guitar support. However, since only the bottom portion of the guitar is supported by the brackets of the guitar support, with the rear side thereof resting against an elastic pad of a support block of the guitar support, when the guitar is hit by an external force, the guitar will fall and may consequently be damaged.

SUMMARY OF THE INVENTION

Therefore, a primary object of the present invention is to provide a light guitar support that can positively hold a guitar in position and protect the guitar from possible damage, and that is foldable in a convenient manner.

Accordingly, a preferred embodiment of a light guitar support of the present invention comprises a support rod, an adjusting unit, two leg supports, two brackets, an upper support rod, a support seat, and a fastening device. The support rod has a lower portion and an upper portion. The upper portion is bent about an angle with respect to the lower portion and forms an insert portion for receiving a lower end of the upper support rod. The support seat is mounted on an upper end of the upper support rod. The support seat includes a transverse clamping plate and a longitudinal clamping plate. The fastening device is mounted at a rear end of the transverse clamping plate to be held thereby when in use or when folded. The fastening device includes an upright bar, a substantially U-shaped fastening seat, a positioning sleeve, and two curved bars. The upright bar has a front end and a rear end. The rear end of the upright bar is mounted on the transverse clamping plate to thereby couple the fastening device to the support seat. The fastening seat is secured to the front end of the upright bar. The protective sleeve is fitted over the fastening seat. The positioning sleeve has a front side formed with two bar receiving holes that have a shape resembling the numeral "8". The curved bars are received in the bar receiving holes such that the curved bars can displace inwardly to a closing position or outwardly to an opening position to clamp or release an upper portion of a guitar to thereby protect the guitar from possible damage.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
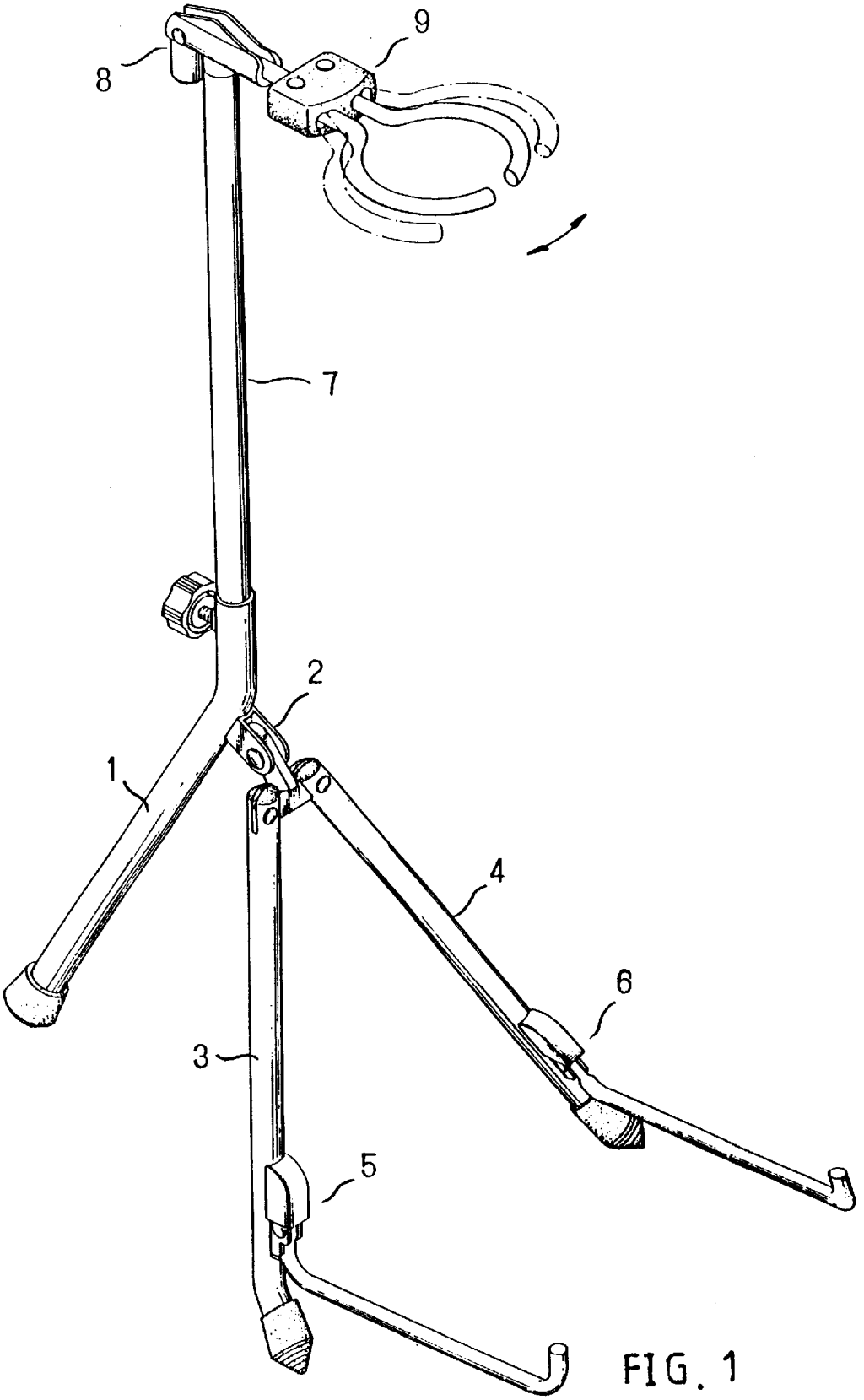
FIG. 1 is a perspective view of a preferred embodiment of the guitar support of the present invention.
Figure 2:
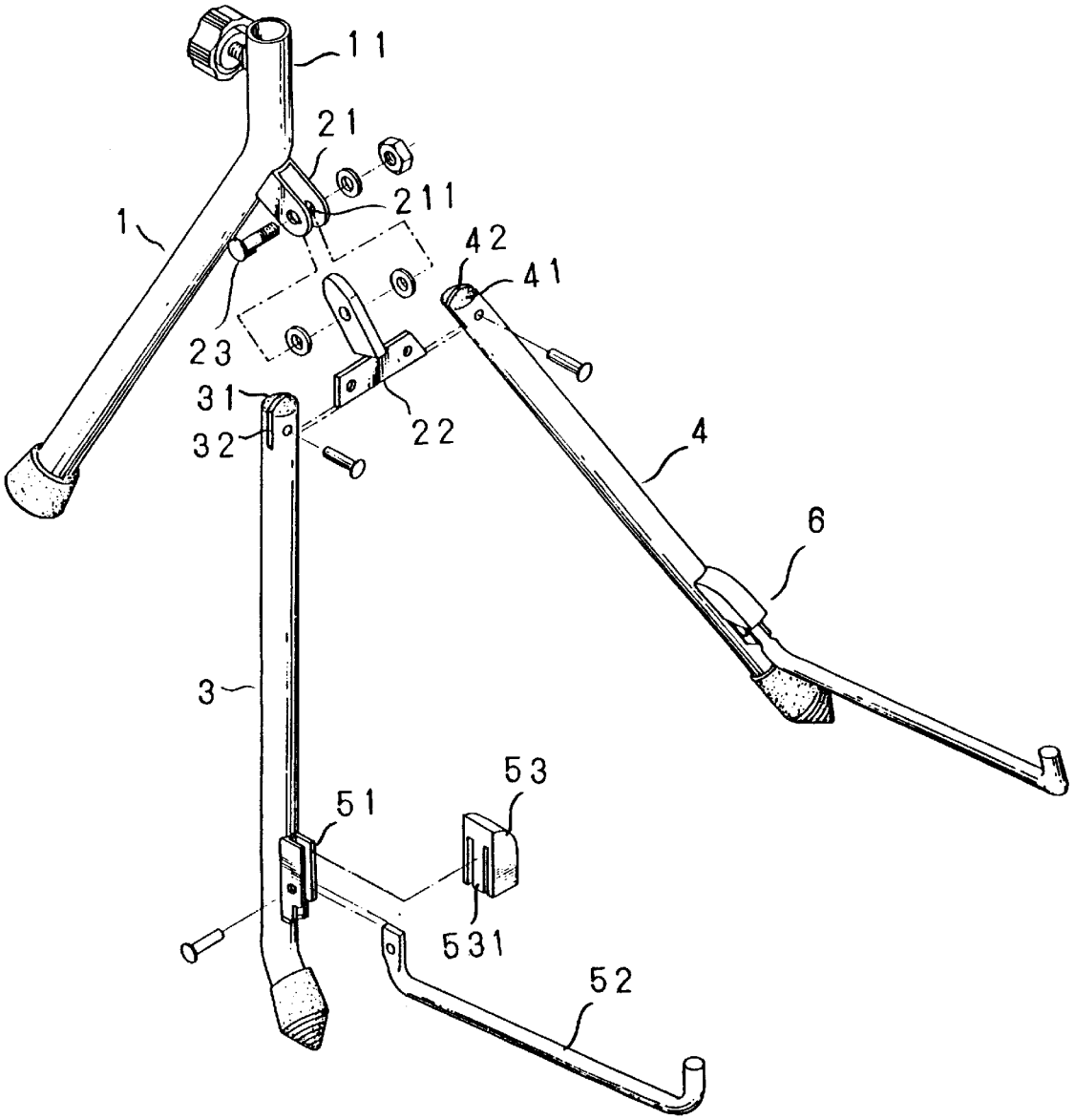
FIG. 2 is a partly exploded view of the preferred embodiment, showing a support rod, an adjusting unit, leg supports, and brackets according to the present invention.
Figure 3:
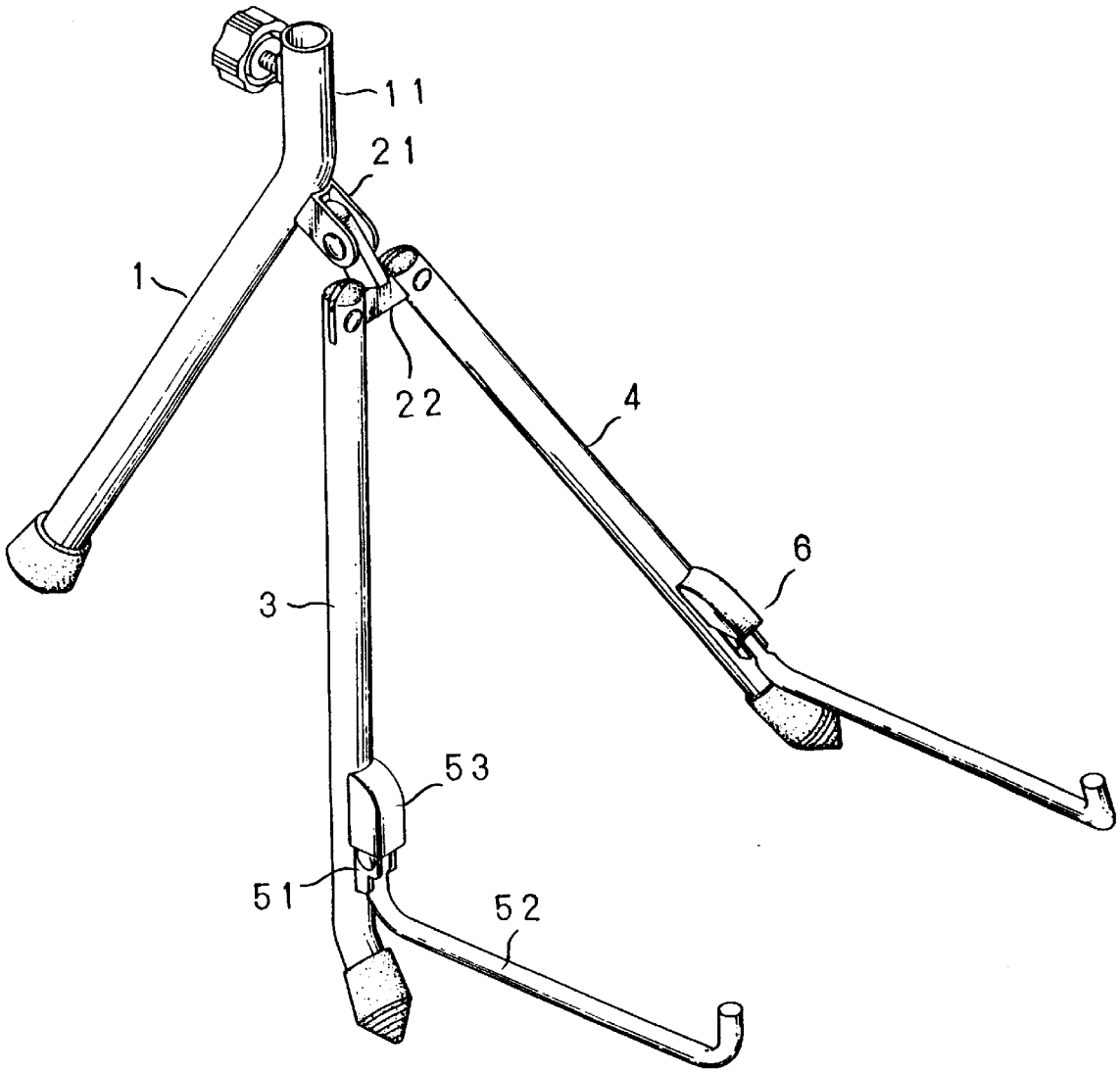
FIG. 3 is a perspective view of the preferred embodiment, showing the support rod, the adjusting unit, the leg supports, and the brackets according to the present invention.
Figure 4:
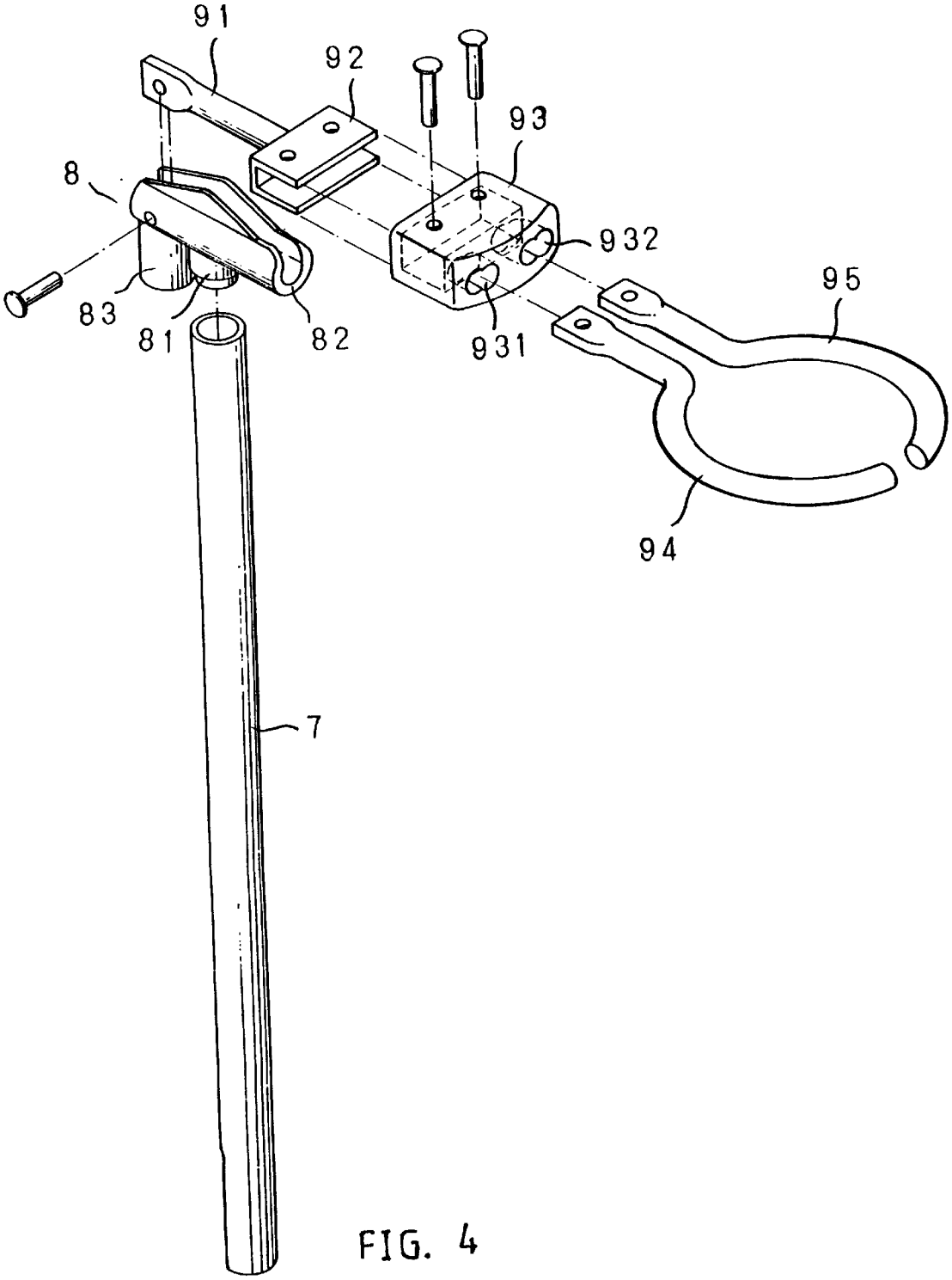
FIG. 4 is an exploded perspective view of the preferred embodiment, showing an upper support rod, a support seat, and a fastening device according to the present invention.

With reference to FIG. 1, the preferred embodiment of a light guitar support of the present invention comprises a support rod 1, an adjusting unit 2, two leg supports 3, 4, two brackets 5, 6, an upper support rod 7, a support seat 8, and a fastening device 9.

The support rod 1 is a hollow tube and is a main support for the guitar frame of the present invention. The support bar 1 has a lower portion and an upper portion. The lower portion is supported on the floor at an angle thereto. The upper portion is bent about an angle with respect to the lower portion and is substantially vertical with respect to the floor. The upper portion forms an insert portion 1.

The adjusting unit 2 includes an inverted U-shaped seat 21 and a T-shaped plate 22 locked by using a screw rod 23. The U-shaped seat 21 is made of metal and is secured to an upper portion of the support rod 1 substantially beneath the insert portion 11. The T-shaped plate 22 includes a horizontal portion and a vertical portion, and is disposed such that the vertical portion is oriented downwardly with the horizontal portion oriented downwardly. A screw hole and two rivets holes are respectively formed in the vertical portion and the horizontal portion of the adjusting unit 2, respectively, and are adapted to receive screw rods or rivets. The vertical portion of the adjusting unit 2 is mounted in the inverted U-shaped seat 21.

The leg supports 3, 4 are also hollow tubes. Each of the leg supports 3, 4 has a connecting portion 31, 41 that is formed with a longitudinal slot 32, 42 for receiving the horizontal portion of the T-shaped plate 22. The T-shaped plate 22 is hence pivotally connected to the leg supports 3, 4 by means of screws or rivets. Each of the leg supports 3, 4 has a lower end bending outwardly so that, when the guitar support is extended in use, the supporting points of the leg supports 3, 4 can extend outwardly to enable the guitar support to stand more firmly on the floor.

Figure 6:
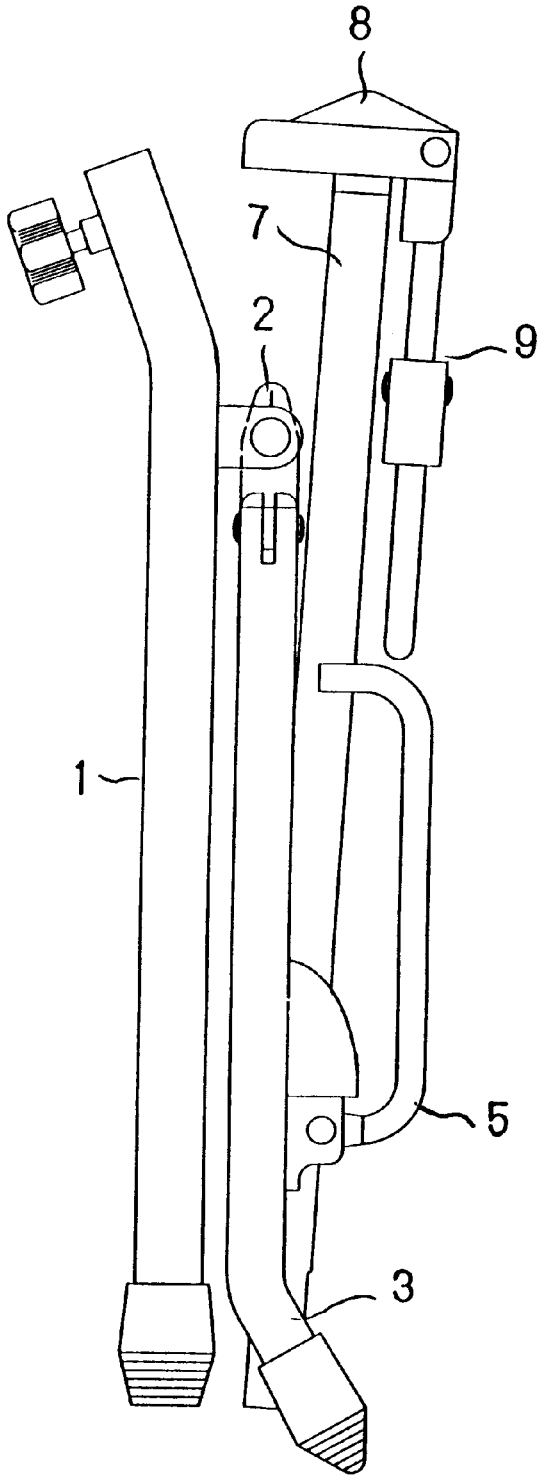
FIG. 6 is a schematic view of the preferred embodiment, showing folding of the guitar support of the present invention.

Each of the brackets 5, 6 includes a supporting seat 51, a bracket body 52, and a protective cover 53. The supporting seat 51 has a cross-section of a generally inverted U-shape, and is secured to the lower end of the leg support 3, 4. The supporting seat 51 includes two side walls provided with rivet holes, respectively. The bracket body 52 is a bar having a rivet hole at one end thereof. A rivet is used to lock pivotally the end of the bracket body 52 with the rivet hole between the side walls of the supporting seat 51. The brackets 5, 6 are adapted to allow placement of a guitar thereon. To close the guitar support of the present invention, the bracket body 52 is moved upwardly, as shown in FIG. 6, to reduce the overall size of the guitar support so as to facilitate storage and carrying. The protective cover 53 is made of a soft plastic material, and is internally provided with a tongue 531 for insertion into a space defined between the two side walls of the supporting seat 51 so as to cover the exterior of the supporting seat 51 and to prevent the guitar from hitting the supporting seat 51, which may damage the guitar.

The upper support rod 7 is a hollow tube that has an upper end and a lower end. The lower end is directly inserted into the insert portion 111 of the support rod 1. The upper end is provided to receive the support seat 8.

The support seat 8 is integrally formed from engineering plastics, and has a bottom side provided with an insert post 81 that can be directly inserted into the upper end of the upper support rod 7. The insert post 81 has a top portion provided with a transverse clamping plate 82. The transverse clamping plate has a curved cross-section and includes a groove between side walls thereof. A longitudinal clamping plate 83 is provided at a rear end of the transverse clamping plate 82.

Figure 5:
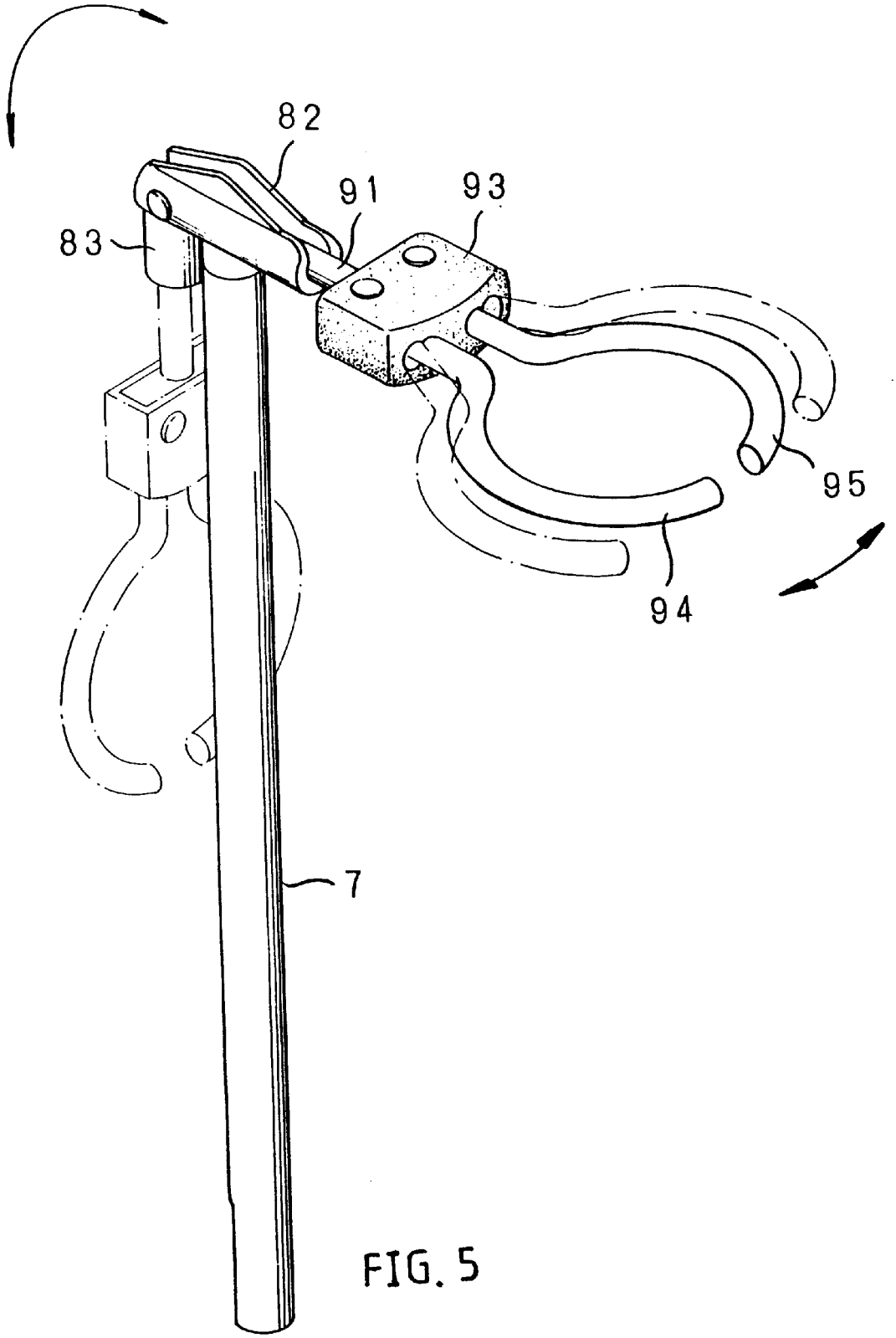
FIG. 5 is an assembled perspective view of the preferred embodiment, showing the upper support rod, the support seat, and the fastening device according to the present invention.

The fastening device 9 includes an upright bar 91, a substantially U-shaped fastening seat 92, a positioning sleeve 93, and two curved bars 94, 95. The upright bar 91 is straight and has a front and rear ends. The rear end is provided with a rivet hole. A rivet can be used to lock the rear end of the upright bar 91 to the rear end of the transverse clamping plate 82. In use, the upright bar 91 can be pressed downwardly to fit into and be retained in the groove of the transverse clamping plate 82. The fastening seat 92 is welded to the front end of the upright bar 9. The fastening seat 92 includes a bottom plate and two side plates extending from both end of the bottom portion, respectively. The side plates are provided with opposed rivet holes. The positioning sleeve 93 is formed from elastic engineering plastics and is fitted over the fastening seat 92. The positioning sleeve 93 has a front side formed with two bar receiving holes 931, 932 that have a shape resembling the numeral "8", a rear side formed with a cavity for receiving the fastening seat 92, and an upper side formed with two rivet holes. The two curved bars 94, 95 are symmetrical and are shaped like hooks. Each of the curved bars 94, 95 has a rivet hole at a rear end thereof. The rear ends of the curved bars 94, 95 extend into the corresponding bar receiving holes 931, 932 to be retained between the side plates of the fastening seat 92, and are pivotally secured in position by means of rivets passing through the aligned rivet holes of the protective sleeve 93, the fastening seat 92, and the curved bars 94, 95. Due to the configuration of the bar receiving holes 931, 932, the curved bars 94, 95 can displace inwardly to a closing position or outwardly to an opening position to clamp or release the upper portion of the guitar (as shown in FIG. 5), preventing the guitar from falling when hit. In storage, the fastening device 9 can be bent rearwardly such that the upright bar 91 is clamped and positioned by the longitudinal clamping plate 83, as shown in FIG. 5, so as to reduce the overall size of the guitar support to save storage space (see FIG. 6).

In the present invention, the support rod 1 is configured to have a bent upper portion forming the insert portion 11 for receiving the upper support rod 7 on which the fastening device 9 can be mounted. It can be appreciated that the present invention is simple in construction and can positively hold a guitar in position. The two curved bars 94, 95 on the upper end of the guitar support can frame the upper portion of the guitar to prevent it from damage.

Although the present invention has been illustrated and described with reference to the preferred embodiment thereof, it should be understood that it is in no way limited to the details of such embodiment but is capable of numerous modifications within the scope of the appended claims.

What is claimed is:

1. A light guitar support comprising a support rod, an adjusting unit, two leg supports, two brackets, an upper support rod, a support seat, and a fastening device, wherein said support rod has a lower portion and an upper portion, said upper portion being bent about an angle with respect to said lower portion and forming an insert portion for receiving a lower end of said upper support rod, said support seat being mounted on an upper end of said support rod;

said support seat includes a transverse clamping plate and a longitudinal clamping plate; and said fastening device is mounted at a rear end of said transverse clamping plate to be held thereby when in use or when folded, said fastening device including an upright bar, a substantially U-shaped fastening seat, a positioning sleeve, and two curved bars, said upright bar having a front end and a rear end, said rear end of said upright bar being mounted on said transverse clamping plate of said support seat to thereby couple said fastening device to said support seat, said fastening seat being secured to said front end of said upright bar, said protective sleeve being fitted over said fastening seat, said positioning sleeve having a front side formed with two bar receiving holes that have a shape resembling the numeral "8", said curved bars being received in said bar receiving holes such that said curved bars can displace inwardly to a closing position or outwardly to an opening position to clamp or release an upper portion of a guitar.

2. A light guitar support as defined in claim 1, wherein each of said brackets includes a supporting seat, a bracket body, and a protective cover, said supporting seat having a cross-section of a generally inverted U-shape, and being secured to a lower end of a respective one of said leg supports for mounting pivotally of one end of said bracket body to facilitate placement of the guitar thereon or upward folding of the guitar; said protective cover being internally provided with a tongue for insertion into a space defined between side walls of said supporting seat so as to cover an exterior of said supporting seat.

* * * * *